United States Patent [19]

Prince

[11] 3,946,817

[45] Mar. 30, 1976

[54] DIFFERENTIALLY CARBURIZED ROCK BIT CUTTER

[75] Inventor: Richard B. Prince, Houston, Tex.

[73] Assignee: Hughes Tool Company, Houston, Tex.

[22] Filed: Dec. 23, 1974

[21] Appl. No.: 535,871

[52] U.S. Cl. ..... 175/374; 148/16.5

[51] Int. Cl.[2] ..... E21B 9/35

[58] Field of Search ..... 175/374, 371, 372, 378; 308/8.2; 148/16.5, 19

[56] References Cited

UNITED STATES PATENTS

| | | | |
|---|---|---|---|
| 2,329,751 | 9/1943 | Fermier | 175/370 X |
| 2,444,724 | 7/1948 | Brown | 175/372 X |
| 2,927,777 | 3/1960 | Steen | 175/378 |
| 2,927,778 | 3/1960 | Coulter | 175/374 X |
| 2,975,083 | 3/1961 | Engelhard | 148/16.5 |
| 3,003,370 | 10/1961 | Coulter | 175/374 X |
| 3,275,389 | 9/1966 | Neilson et al. | 308/8.2 |
| 3,398,444 | 8/1968 | Nemy | 148/16.5 X |
| 3,842,921 | 10/1974 | Dill et al. | 175/374 |

*Primary Examiner*—Frank L. Abbott
*Assistant Examiner*—Richard E. Favreau
*Attorney, Agent, or Firm*—Robert A. Felsman

[57] ABSTRACT

Disclosed herein is a cutter for a rock bit that has an interior bearing race area carburized by pack carburization methods to achieve a high carbon content for extreme hardness. The exterior of the cutter is carburized also, but to a lesser degree, to avoid brittleness in the tooth area. The differential carburizing is accomplished by gas carburizing the exterior while simultaneously pack carburizing the interior. Conventional heat treatment for hardening follows. This results in a cutter having a bearing area much harder than the exterior, giving a long bearing life and reducing tooth breakage.

8 Claims, 3 Drawing Figures

DIFFERENTIALLY CARBURIZED ROCK BIT CUTTER

BACKGROUND OF THE INVENTION

1. Field of the Invention

This invention relates in general to earth boring drill bits, particularly to improved cutters for rock bits that have a high hardness on an interior bearing race and a lower hardness on the exterior tooth area to avoid tooth breakage.

2. Description of the Prior Art

A typical cutter for an earth boring rock bit is cone-shaped and contains earth disintegrating teeth on the exterior. The interior is partially hollow with bearing races to support bearings upon which each cutter rotates on the bearing pin of a head section.

It is known that higher carbon content in a steel cutter increases hardenability. To achieve high carbon content, normally a cutter carburized, then hardened and tempered. These processes act on the entire cutter, providing a fairly uniform degree of hardness and carbon content both on the interior and exterior.

Long bearing life is essentially and therefore the carburizing process of necessity produced a high carbon content. After hardening and tempering, excessive hardness in the exterior tooth area caused brittleness, occassional fatigue and tooth breakage.

SUMMARY OF THE INVENTION

This invention relates to the discovery that rock but cutter life is improved if the carbon content in the interior bearing area is higher than that on the exterior of the cutter. By packing the interior with a solid particle carburizing material, sealing, then gas carburizing the exterior, a differential carbon gradient is simultaneously achieved. Conventional hardening and quenching provides a cutter with an extremely hard interior bearing area because of the high carbon content from the solid particle carburizing material, and a softer exterior because of the lower carbon content from the gas carburizing on the exterior. Long bearing life is retained and tooth failure due to breakage reduced. Other objects, features and advantages will become apparent hereinafter.

DESCRIPTION OF THE PREFERRED EMBODIMENT

Figure 1:
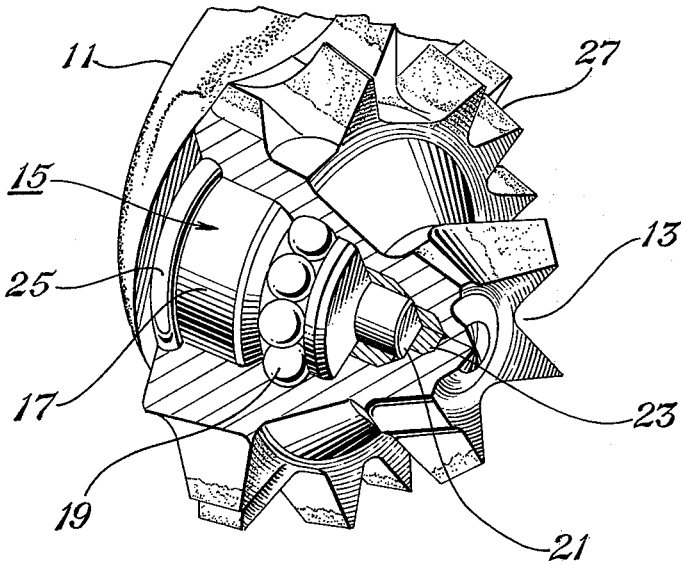
FIG. 1 is a fragmentary perspective view, partially in section, showing a rotatable cutter mounted on suitable bearing means extending in cantilevered fashion from a drill bit leg or head section.

The numeral 11 in the drawing designates a leg or head section of a typical earth boring drill bit that supports a toothed, rotatable cutter 13. Typically a drill bit will contain three sections 11 and cutters 13.

Figure 2:
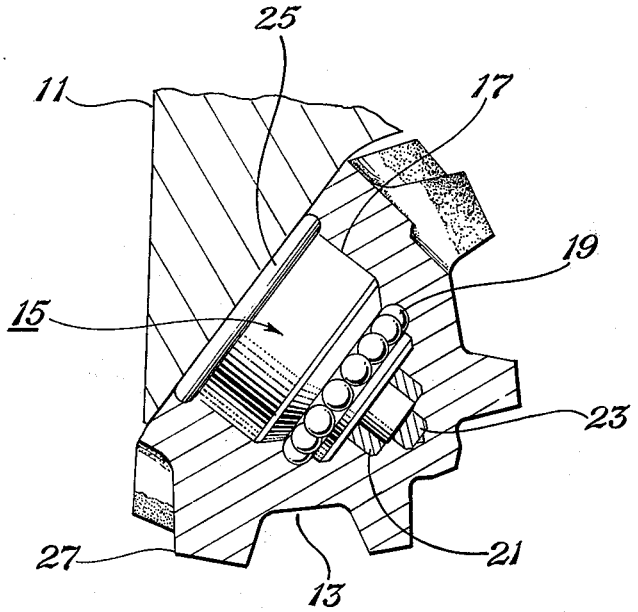
FIG. 2 is a fragmentary side elevational view, partially in section, of the cutter of FIG. 1.

A cutter 13 such as that shown in FIGS. 1 and 2 is generally mounted on a head section 11 with a cantilevered shaft or bearing pin 15 that forms a bearing means for the interior of the cutter 13. The particular bearing means illustrated has a friction bearing 17, a row of ball bearings 19, and additional friction bearing means utilizing the bushings 21 and thrust button 23. In this instance a seal means such as O-ring 25 is placed in a suitable groove means between the bearing pin 15 and cutter 13 to retain a lubricant within the bearing region. Teeth 27 disintegrate the earth as the cutter 13 rotates.

Figure 3:
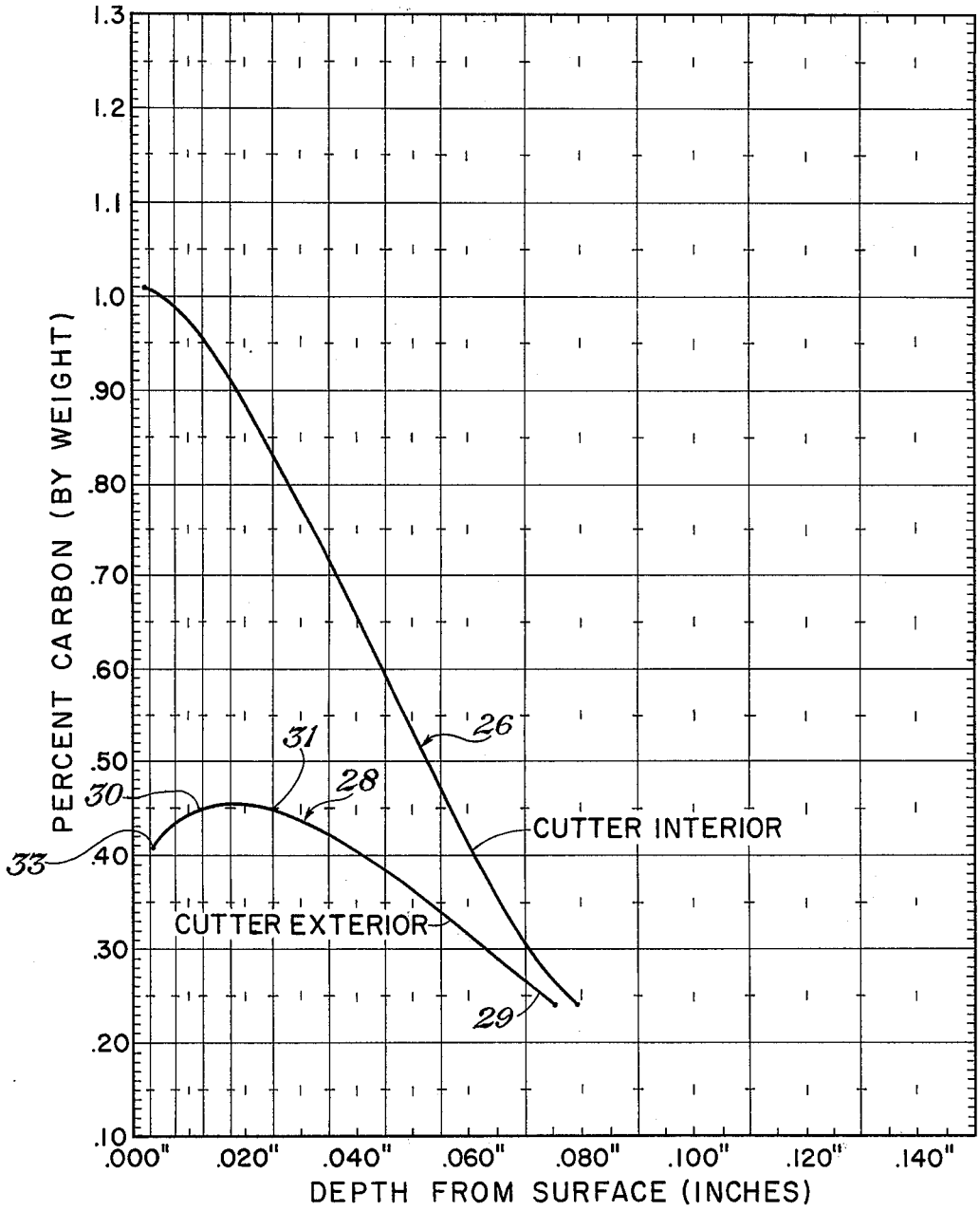
FIG. 3 is a graph of preferred carbon gradients in the interior bearing area and exterior tooth area of a cutter.

The graph of FIG. 3 shows the percent of carbon by weight in A.I.S.I. 4815 steel versus depth, plotted linearly for the interior and exterior of a cutter of a 7⅞ inch rock bit, respectively identified by the numerals 26 and 28. The vertical grid lines represent the depth of a standard cut used to analyze carbon gradient. The two curves represent the carbon gradients of the preferred carburized cases, and case is defined herein to be the layer near the surface wherein the carbon content has been increased over the nominal uniform carbon content of the steel. The curves 26, 28 show the carbon gradients down to 0.24% carbon content, which corresponds to Rockwell "C" hardness of 50 Rc after hardening, as later described, while the nominal carbon content for that steel is 0.15%.

The carbon gradients are the slopes of the curves or the change of the carbon content over a given depth distance. These desired carbon gradients may be achieved by differential carburizing.

The preferred procedure of differentially carburizing the cutter 13 is achieved by combining the process of pack carburizing with the process of gas carburizing, both known arts. Pack carburizing is described on pages 115–118 of Vol. 2 of the 8th Edition of the *Metals Handbook*, "Heat Treating, Cleaning and Finishing" (American Society for Metals, 1964). Gas carburizing is described on pages 93–114 of the same reference, all the material of which is incorporated in this specification by reference.

One method of differential carburizing a rotatable cutter made of A.I.S.I. 4815 steel to achieve the carbon gradients of FIG. 3 includes the following steps. First the interior bearing area of the cutter is packed with a solid particle carburizing compound. These compounds are commercially available and preferably have a chemical analysis approximately as follows:

| | |
|---|---|
| Barium Carbonate | 3.5 – 5.2% (by weight) |
| Calcium Carbonate | 1.0 – 2.0% |
| Binder | 4.0 – 6.0% |
| Charcoal | balance |

The compound is held in place with a metal cap which fits over the mouth of the cutter and seals the interior from the exterior atmosphere.

Then the cutter is placed in a carburizing furnace, either continuous or batch type. The furnace atmosphere is endothermic gas enriched with methane to have a carbon potential of approximately 1.00–1.10% carbon. This potential may vary with the type of fuel used, and a typical analysis of the carburizing gas (atmosphere) is as follows:

40%$N_2$ (by weight)
20%CO ($CO_2$ about 0.07%)
38%$H_2$
2%$CH_4$ The cutter is heated to approximately 1700°F. for about 9 hours at this carbon potential. Carbon from the gas enters the cutter 13 exterior forming a carbon gradient of substantially linear slope represented by the curve 28 between the points 29 and 31 on FIG. 3. Also during this part of the process, carbon from the solid particle compound enters the cutter interior bearing area forming a carbon gradient curve 26, which appears approximately linear as in FIG. 3.

Then the carbon on cutter 13 exterior is diffused by increasing the percent of $CO_2$ of the atmosphere to lower the carbon potential of the furnace to approximately 0.45–0.55% carbon. Heating is continued at 1700°F. for an additional 6 hours. This creates a nonlinear portion of the carbon gradient curve as represented by the line 30 between points 31 and 33 in FIG. 3. During the diffusion process no additional carbon is added to the cutter exterior, resulting in a carbon content at the surface which appears in FIG. 3 to be about 0.40%. The maximum carbon content appears in FIG. 3 to be about 0.45% at 0.020 inch case depth. The surface carbon content and maximum carbon content may vary in the preferred embodiment within the range of 0.30–0.50% for the surface, and less than 0.55% maximum. Having the maximum carbon in the case and not at the surface lessens the tendency for fatigue cracks in the surface. Without the diffusion process, the carbon gradient would appear approximately linear on the graph of FIG. 3 similar to the cutter exterior curve, resulting in a much higher surface carbon. The interior which is sealed from the atmosphere is not affected by the diffusion process.

The next steps of the process are hardening and tempering. The solid particle carburizing compound is removed prior to these steps. Then hardening, usually quenching in agitated oil, from a temperature of at least 1390°F., can be performed using one of the following procedures for carburized A.I.S.I. 4815 steel to produce a substantially martensitic case:

a. Double quench from a carburizing or reducing atmosphere maintained at 2.2% $CO_2$ and temperature of respectively 1,650°F. and 1,440°F. is preferred;

b. Single quench from a carburizing or reducing atmosphere and a temperature of 1,500°F.

The tempering temperature is usually low, 290°F. – 510°F., preferably about 335°F. for 1 hour to toughen the carburized case without appreciably lowering its strength (hardness) to produce tempered martensite.

After machining the interior bearing area of the cutter, the following results can be expected:

| | Cutter Exterior | Cutter Interior |
|---|---|---|
| Surface carbon | .30 – .50% | .85 – 1.05% |
| Maximum carbon | .55% | at surface |
| Surface hardness | 42 – 50 Rc | 57 – 63 Rc |
| Maximum hardness | 57 Rc at .020 inch | at surface |

Various case depths can be obtained by using shorter or longer time cycles. Deeper case depths may be required for larger bit size and for different types of bits; i.e., a cutter for a 12¼ inch bit may be in the range from 0.100–0.120 inch case depth while a cutter for a 5⅞ inch bit may be in the range from 0.50–0.70 inch. The depth at which maximum carbon content occurs within the cutter exterior case also varies accordingly. In any case, however, the case depths of the interior and exterior will be substantially equal.

The case microstructure of the cutter exterior should have no ferrite at the surface. The carbon gradient should have a maximum carbon level of 0.55% and the microstructure should be similar to that of quenched and tempered A.I.S.I. 4340 steel. The case microstructure and carbon gradient of the cutter interior bearing area should be the same as on a standard steel tooth cutter.

Drop impact tests to indicate impact strength of the cone exterior of this invention were performed on notched specimens. One group of specimens were gas carburized in the normal manner used in manufacturing cutters, giving a fairly high surface carbon content. A second group was gas carburized in accordance with the teachings of this specification, that is; 9 hours at 1,700°F. in an atmosphere containing 1.00–1.10% carbon potential, then 6 hours at 1,700°F. in an atmosphere containing 0.45–0.55% carbon potential. A third group was gas carburized as the first group except the notch was painted with case preventative paint to avoid carburization in that area.

The impact strength of the first group averaged 26 in-lbs, the second group approximately 49 in-lbs and the third group approximately 33 in-lbs. The higher impact strength of the cutter exterior with a carburized case of this invention indicates more toughness or overall capacity of the tooth area to absorb energy, indicating less breakage.

The advantages of the differential carburized cutter were further demonstrated by field tests of three cutters constructed in accordance with the teachings of this specification. They were assembled with head sections to form an earth boring drill bit, which was secured during operation to the lower end of a drill string member by threads. The drill string was then lowered and rotated to urge the cutter teeth into the earth's formation. The bits of the present invention exhibited a bearing life comparably to that obtained with the prior art cutter. In addition, there was a significant reduction of tooth breakage in some instances.

While the differential carburized cutter has been shown in only one form, it should be apparent to those skilled in the art that it is not so limited, but cutters and bearing surfaces or other configurations may also contain differential carburized cases. In addition selective portions of the cutter may be painted with a commercially obtainable case preventive paint should carburization of only certain portions be desired. Also the method of achieving the different carburized cases may be modified without departing from the spirit thereof.

I claim:

1. In an earth boring bit, an improved rotatable cutter comprising:

a first carburized case on the cutter exterior;

a second carburized case on the cutter interior;

said second case having a substantially higher carbon content at its surface than said first case;

said first and second carburized cases being hardened to produce a cutter with an interior substantially harder than the exterior, providing a cutter resistant to tooth breakage while maintaining a wear resistant bearing surface.

2. The cutter as defined by claim 1 wherein the case depths of said first case and said second case are substantially equal.

3. The cutter as defined by claim 1 wherein the surface carbon content by weight of said first case is within the range of 0.30–0.50% and said second case within the range of 0.85–1.05%.

4. The cutter as defined by claim 1 wherein the maximum carbon content by weight of said first case is less than 0.55%. and the maximum carbon content by weight of said second case after machining is greater than 0.85%.

5. The cutter as defined by claim 1 wherein the first carburized and hardened case has a surface hardness in the range from 42–50 Rc and the second carburized and hardened case has a surface hardness in the range from 57–63 Rc.

6. The cutter as defined by claim 1 wherein the maximum hardness of the first carburized and hardened case is less than 57 Rc and occurs within the case, and the second carburized and hardened case has a maximum hardness greater than 57 Rc and occurs at the surface.

7. In an earth boring bit, an improved rotatable cutter comprising:

a first carburized case on the cutter exterior;

said first case having a carbon gradient with the maximum carbon content of said case within said case and not at the surface;

a second carburized case on the cutter interior;

said second case having a substantially higher carbon gradient than said first case substantially throughout the depths of said cases;

said second case having a carbon content which is maximum at surface and decreases with depth;

said first and second carburized cases being hardened to produce a cutter with an interior substantially harder than the exterior, providing a cutter resistant to tooth breakage while maintaining a wear resistant bearing surface.

8. In an earth boring bit, an improved rotatable cutter comprising:

a first carburized case on the cutter exterior;

the carbon content by weight of said first case at the surface being in the range from 0.30–0.50%;

the carbon content by weight within said first case varying with depth, with the maximum carbon content less than 0.55% and occurring within said case;

a second carburized case on the cutter interior;

the depth of said second case and said first case being substantially equal and in the range from 0.050–0.120 inch;

the carbon content by weight of said second case being substantially higher than said first case at least to the depth at which the carbon content of said first case is 0.24%;

the carbon content by weight of said second case at the surface being within the range of 0.85–1.05% after machining;

the carbon content by weight within said second case decreasing with depth, with the maximum carbon content occurring at the surface of said second case;

the surface hardness of said first and second cases after heat treatment being in the range from 42–50 Rc on said first case and after machining 57–63 Rc on second case;

the maximum hardness in said first case being less than 57 Rc occurring within said case, and maximum hardness in said second case occurring at the surface;

whereby said cutter is resistant to tooth breakage while maintaining a wear resistant bearing surface.

* * * * *

UNITED STATES PATENT OFFICE

CERTIFICATE OF CORRECTION

Patent No. 3,946,817 Dated March 30, 1976

Inventor(s) Richard B. Prince

It is certified that error appears in the above-identified patent and that said Letters Patent are hereby corrected as shown below:

At Col. 3, line 23, "exterior" is changed to ---interior---.

Signed and Sealed this

Sixth Day of July 1976

[SEAL]

*Attest:*

RUTH C. MASON
*Attesting Officer*

C. MARSHALL DANN
*Commissioner of Patents and Trademarks*